US011808123B2

(12) United States Patent
Calvert et al.

(10) Patent No.: US 11,808,123 B2
(45) Date of Patent: Nov. 7, 2023

(54) SYSTEMS AND METHODS FOR MANAGING SKIN WITHIN A SUBTERRANEAN WELLBORE

(71) Applicant: BP Exploration Operating Company Limited, Middlesex (GB)

(72) Inventors: Patrick Calvert, London (GB); Gennaro Dello Ioio, Cambridge (GB); Andrew Woods, London (GB)

(73) Assignee: BP Exploration Operating Company Limited

( * ) Notice: Subject to any disclaimer, the term of this patent is extended or adjusted under 35 U.S.C. 154(b) by 66 days.

(21) Appl. No.: 17/627,104

(22) PCT Filed: Jul. 9, 2020

(86) PCT No.: PCT/EP2020/069392
§ 371 (c)(1),
(2) Date: Jan. 13, 2022

(87) PCT Pub. No.: WO2021/009000
PCT Pub. Date: Jan. 21, 2021

(65) Prior Publication Data

US 2022/0275713 A1 Sep. 1, 2022

(30) Foreign Application Priority Data

Jul. 18, 2019 (EP) ..... 19187146
Jul. 18, 2019 (EP) ..... 19187148

(51) Int. Cl.
*E21B 43/12* (2006.01)
*E21B 43/14* (2006.01)

(52) U.S. Cl.
CPC ..... *E21B 43/14* (2013.01)

(58) Field of Classification Search
CPC ..... E21B 43/12; E21B 47/06
See application file for complete search history.

(56) References Cited

U.S. PATENT DOCUMENTS 5,234,057 A * 8/1993 Schultz ..... E21B 49/0815 702/6
5,703,286 A * 12/1997 Proett ..... E21B 49/10 73/152.05

(Continued)

FOREIGN PATENT DOCUMENTS

| | | | |
|---|---|---|---|
| GB | 2544098 | A | 5/2017 |
| WO | 2013/072490 | A2 | 5/2013 |
| WO | 2018034802 | A1 | 2/2018 |

OTHER PUBLICATIONS

International Patent Application No. PCT/EP2020/069392 Written Opinion of the International Searching Authority and International Search Report dated Oct. 6, 2020 (13 pages).

(Continued)

*Primary Examiner* — Kenneth L Thompson
(74) *Attorney, Agent, or Firm* — Conley Rose, P.C.

(57) ABSTRACT

Systems and methods are disclosed for managing skin in a subterranean wellbore. In an embodiment, the method includes oscillating a drawdown pressure of the subterranean wellbore in a predetermined pattern that comprises a plurality of alternating drawdown pressure increases and drawdown pressure decreases. The drawdown pressure increases of the predetermined pattern comprise increasing the drawdown pressure at a first rate, and the drawdown pressure decreases of the predetermined pattern comprise decreasing the drawdown pressure at a second rate that is different from the first rate.

20 Claims, 9 Drawing Sheets

(56) References Cited

U.S. PATENT DOCUMENTS

| | | | | |
|---|---|---|---|---|
| 6,843,118 | B2 * | 1/2005 | Weintraub | E21B 49/008 73/152.05 |
| 8,555,966 | B2 * | 10/2013 | Maxit | E21B 49/087 166/264 |
| 9,581,019 | B2 * | 2/2017 | Chang | E21B 49/008 |
| 9,638,034 | B2 * | 5/2017 | Chen | E21B 47/06 |
| 11,230,923 | B2 * | 1/2022 | Proett | E21B 49/008 |
| 11,359,480 | B2 * | 6/2022 | Jones | E21B 49/10 |
| 2013/0277063 | A1 | 10/2013 | Palka | |

OTHER PUBLICATIONS

Zenith F et al., "Well Testing by Sinusoidal Stimulation," SPE Reservoir Evaluation and Engineering, vol. 18, No. 03, Aug. 2015, pp. 441-451.

Rochon J et al., "Method and Application of Cyclic Well Testing With Production Logging," SPE Annual Technical Conference and Exhbition, Sep. 21-24, 2008, Denver, Colorado, USA, Society of Petroleum Engineers, No. SPE 115820, Sep. 21, 2008, pp. 1-15.

Extended European search report for EP Patent Application No. 19187148.2 dated Jan. 17, 2020 (9 pages).

Extended European search report for EP Patent Application No. 19187146.6 dated Jan. 20, 2020 (11 pages).

Pål et al., "Robust Automatic Well Choke Control—Physical Constraint Based Operation," IFAC DYCOPS-CAB, 2016, Trondheim, Norway, pp. 296-301.

UK IPO Search Report dated Apr. 18, 2023 for Application No. GB2200766.0.

* cited by examiner

SYSTEMS AND METHODS FOR MANAGING SKIN WITHIN A SUBTERRANEAN WELLBORE

CROSS-REFERENCE TO RELATED APPLICATIONS

This application is a National Phase Entry into the U.S. under 35 U.S. § 371 of and claims priority to PCT Application No. PCT/EP2020/039392, filed Jul. 9, 2020, entitled "SYSTEMS AND METHODS FOR MANAGING SKIN WITHIN A SUBTERRANEAN WELLBORE," which claims benefit of European patent application No. EP19187146.6 filed on Jul. 18, 2019, and entitled "SYSTEMS AND METHODS FOR MANAGING SKIN WITHIN A SUBTERRANEAN WELLBORE," and European patent application No. EP19187148.2 filed Jul. 18, 2019, and entitled "SYSTEMS AND METHODS FOR MANAGING SKIN WITHIN A SUBTERRANEAN WELLBORE," the entire contents of each being hereby incorporated herein by reference for all purposes.

STATEMENT REGARDING FEDERALLY SPONSORED RESEARCH OR DEVELOPMENT

Not applicable.

BACKGROUND

This disclosure relates generally to systems and methods for producing hydrocarbons from a subterranean formation. More particularly, this disclosure relates to systems and methods for controlling or managing skin in a gravel packed wellbore extending within a subterranean formation.

To obtain hydrocarbons from subterranean formations, wellbores are drilled from the surface to access the hydrocarbon-bearing formation (which may also be referred to herein as a producing zone). After drilling a wellbore to the desired depth, a production string is installed in the wellbore to produce the hydrocarbons from the producing zone to the surface. To prevent the free migration of fine particulate matter from the producing zone, which is generally referred to herein as "fines," into the completion and production tools along with any produced hydrocarbons, a screen (or multiple screens) may be installed in the wellbore (within an open borehole or a perforated casing pipe). In addition, a properly sized proppant, such as sand or other particulate, which is generally referred to herein as "gravel," is placed downhole. More specifically, gravel is positioned within the formation as well as the annulus positioned radially outside of the screen (e.g., an annulus radially positioned between the screen and the perforated casing pipe or borehole sidewall). Once in place, the gravel forms a barrier to filter the fines from the production fluids such that the fines are prevented from passing through the screens and being produced to the surface. This type of completion configuration is often referred to as a gravel pack completion. When a gravel pack completion is performed within an open borehole, the completion may be referred to as an "open hole gravel pack completion," and when a gravel pack completion is performed within a cased or lined wellbore, the completion may be referred to as a "cased hole gravel pack completion."

BRIEF SUMMARY

Some embodiments disclosed herein are directed to a method of managing skin in a subterranean wellbore. In an embodiment, the method includes oscillating a drawdown pressure of the subterranean wellbore in a predetermined pattern that comprises a plurality of alternating drawdown pressure increases and drawdown pressure decreases. The drawdown pressure increases of the predetermined pattern comprise increasing the drawdown pressure at a first rate, and the drawdown pressure decreases of the predetermined pattern comprise decreasing the drawdown pressure at a second rate that is different from the first rate.

Other embodiments disclosed herein are directed to a system for producing hydrocarbons from a subterranean wellbore. In an embodiment, the system includes a production tubing installed within the wellbore. In addition, the system includes a choke valve fluidly coupled to the production tubing such that formation fluids that flow into the wellbore are communicated to the choke valve via the production tubing. Further, the system includes a controller coupled to the choked valve. The controller is configured to selectively actuate the choke valve to: oscillate a drawdown pressure of the wellbore in a predetermined pattern that comprises a plurality of alternating drawdown pressure increases and drawdown pressure decreases. The drawdown pressure increases of the predetermined pattern comprise increases of the drawdown pressure at a first rate, and the drawdown pressure decreases of the predetermined pattern comprise decreases of the drawdown pressure at a second rate that is different from the first rate.

Still other embodiments disclosed herein are directed to a non-transitory machine-readable medium. In an embodiment, the non-transitory machine-readable medium contains instructions that, when executed by a processor, cause the processor to actuate a choke valve to oscillate a drawdown pressure of a subterranean wellbore in a predetermined pattern that comprises a plurality of alternating drawdown pressure increases and drawdown pressure decreases. The drawdown pressure increases of the predetermined pattern comprise increases of the drawdown pressure at a first rate, and the drawdown pressure decreases of the predetermined pattern comprise decreases of the drawdown pressure at a second rate that is different from the first rate.

The instructions, when executed by the processor, may further cause the processor to actuate the choke valve to oscillate the drawdown pressure in the predetermined pattern about a first predetermined target value; and then, actuate the choke valve to oscillate the drawdown pressure in a second predetermined pattern about a second predetermined target value that is different than the first predetermined target value.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
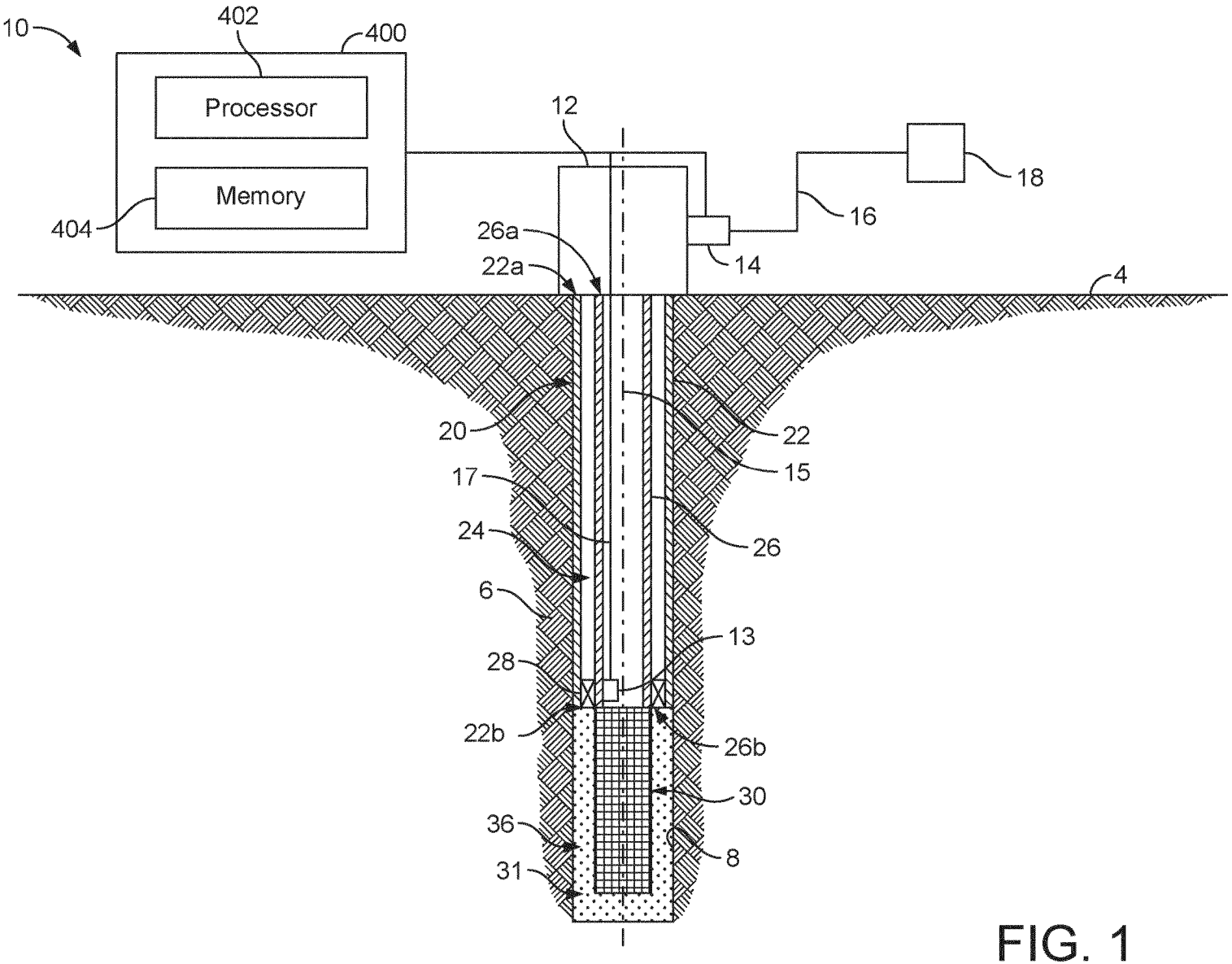
FIG. 1 schematic cross-sectional view of a system for producing formation fluids from a subterranean formation in accordance with embodiments described herein.

The following discussion is directed to various exemplary embodiments.

However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. As used herein, the term "formation fluids" refers to liquids and gases that are produced from a subterranean formation into a wellbore or other communication channel. For example, the term may include oil, hydrocarbon gases, water, condensate, etc. As used herein, the terms "about," "approximately," "substantially," "generally," etc. mean within a range of plus or minus 20% of the stated value, unless specifically stated otherwise.

As previously described, gravel pack completions (including both open hole and cased hole gravel pack completions) include injecting a gravel into an annular space disposed about one or more screens (e.g., tubular screens) within a wellbore. The injected gravel functions to filter fines that may be produced from the subterranean formation along with other formation fluids (e.g., oil, gas, condensate, water, etc.), and therefore restrict and/or prevent the fines from being produced to the surface. However, during production operations, the fines may collect within the gravel pack and form a "skin" that undesirably restricts formation fluids from flowing through the gravel pack. In some cases, skin formation can ultimately prevent a substantial portion of the formation fluids from being produced. Remedial measures can be taken to reduce the skin. One such remedial measure is referred to as an "acid job" and involves flowing acid into the subterranean wellbore to dissolve the particles forming the skin. However, an acid job is typically expensive, and can also lead to increased corrosion and wear of the components within the wellbore. Moreover, the benefits afforded by an acid job may be short lived as additional fines will continue to be produced from the formation after the acid job is complete.

Accordingly, embodiments disclosed herein include systems and methods for managing skin within a subterranean wellbore by controllably and selectively adjusting the drawdown pressure over time to manage skin formation. In particular, embodiments disclosed herein include inducing controlled oscillations (e.g., alternating increases and decreases) of the drawdown pressure within the subterranean wellbore to discourage the formation of skin and potentially remove or reduce skin that has already formed within the gravel pack. Thus, through use of the systems and methods described herein, an operator may reduce or potentially eliminate the need for a relatively expensive and potentially harmful acid job within a subterranean wellbore.

While the specific embodiments described herein provide for controllably and selectively oscillating the drawdown pressure within a gravel packed wellbore (i.e., a wellbore with either an open hole or a cased holed gravel pack completion as described above), it should be appreciated that the systems and methods (such as the below described drawdown pressure oscillations) can be utilized within other types of wellbore completions (i.e., other than gravel pack completions). For example, in some embodiments, the below described pressure oscillations can be utilized within a so called stand-alone screen completion, whereby fluids are produced directly from the formation into a downhole screen (or multiple screens) without an intervening layer of injected gravel (such as would be the case for a gravel pack completion). In such a completion, skin (e.g., from formation fines) can form within the formation and/or along the screen itself. Without being limited to any particular theory, application of the below described drawdown pressure oscillations may prevent and or reduce skin within a stand-alone screen completion in substantially the same manner as specifically described below for a gravel pack completion.

As used herein, the term "drawdown pressure" refers to the pressure differential between the pressure of a subterranean formation and the pressure of a wellbore extending through the formation (this is sometimes also referred to as the "pressure drawdown"). To allow production fluids to enter the wellbore for production to the surface, the drawdown pressure is set such that the pressure within the wellbore is generally less than the pressure of the formation. Thus, the drawdown pressure drives formation fluids from the subterranean formation into the wellbore during production operations, and one would normally expect the drawdown pressure to be directly proportional to the flow rate of production fluids into the wellbore. Accordingly, as the drawdown pressure increases (i.e., the pressure differential between the formation and wellbore increases) the flow rate of formation fluids into the wellbore from the formation should also increase. As described herein, the drawdown pressure may be influenced or managed by the operation of choke valves or other pressure adjustment devices at the surface.

Referring now to FIG. 1, a system 10 for producing formation fluids from a subterranean formation 6 is shown. System 10 generally includes equipment 12 disposed at the surface 4 (so that equipment 12 may be referred to herein as "surface equipment"), and a wellbore 20 extending from the surface 4 into subterranean formation 6 along a central or longitudinal axis 15. Axis 15 is shown to be a generally linear in FIG. 1; however, it should be appreciated that axis 15 may not be linear in other embodiments (e.g., a subterranean wellbore 20 is seldom perfectly straight and may deviate based on a variety of factors). In addition, while wellbore 20 is shown to be a vertical wellbore, it should be appreciated that wellbore 20 may include one or more lateral or substantially lateral sections or portions in other embodiments. Thus, the depiction of a linear, vertical axis 15 of wellbore 20 is included in the drawings in order to simplify the following description and should not be interpreted to limit the potential deviations or variations of wellbore 20 in other embodiments.

In general, surface equipment 12 may include any suitable equipment for supporting or facilitating the production of formation fluids from formation 6 via wellbore 20 such as, for example, a production tree valve assembly (e.g., a Christmas tree valve assembly). Surface equipment 12 includes or is coupled to a choke valve 14 configured to control the flow rate of formation fluids from wellbore 20 into a production line or conduit 16. Conduit 16 supplies the production fluids to a destination 18, which may comprise a pipeline, manifold, tank, processing plant, or other suitable destination for formation fluids emitted from wellbore 20. In addition, surface equipment 12 may include electronic control equipment (such as, for example, controller 400 described in more detail below) for controlling or operating various components or features within system 10. The electronic control equipment (e.g., controller 400) may be disposed within a local control room (not shown) for system 10 or at any suitable location (including for example, a location that is remote from wellbore 20).

A casing or liner pipe 22 extends axially from or proximate to surface 4 (e.g., from surface equipment 12) into wellbore 20. Casing 22 provides structural support to wellbore 22 and prevents formation fluids from entering wellbore 20 from uncontrolled locations or depths. Casing 22 is secured within wellbore 20 via cement or any other suitable mechanism or material. In particular, casing 22 includes a first or upper end 22*a* disposed at or proximate to surface 4, and second or lower end 22*b* disposed within wellbore 20.

A production tubing string 26 is also inserted within wellbore 20 within the casing 22. Tubing string 26 communicates formation fluids emitted from formation 6 to the surface 4, where they are then communicated through the choke valve 14 and production conduit 16 to destination 18 as previously described above. Tubing string 26 includes a first or upper end 26*a* disposed at or proximate to the surface 4 and a second or lower end 26*b* disposed within wellbore 20. Lower end 26*b* of tubing string 26 may be disposed above or below lower end 22*b* of casing 22, and in some embodiments, lower end 26*b* of tubing string 26 may be axially aligned (or substantially axially aligned) with lower end 22*b* of casing 22. A screen assembly 30 is coupled to lower end 26*b* of tubing string 26 and extends axially therefrom. Screen assembly 30 comprises one or a plurality of screens (not specifically depicted in FIG. 1) for filtering formation fluids emitted from formation 6 during production operations.

Referring still to FIG. 1, an annulus or annular region 31 between screen assembly 30 and the borehole sidewall 8 below lower end 22*b* of casing 22 is filled with a gravel pack 36. A packer or seal 28 is installed in the annulus 24 between tubing string 26 and casing 22 at or proximate lower ends 22*b*, 26*b* to fluidly isolate annulus 31 from annulus 24 and therefore prevent the flow of fluid or gravel axially upward to the surface 4 via annulus 24 during operations. Thus, as formation fluids are emitted from borehole sidewall 8, they are directed through the gravel pack 36 and the screen assembly 30 so that the formation fluids may then flow up through tubing string 26 to the surface 4.

Figure 2:
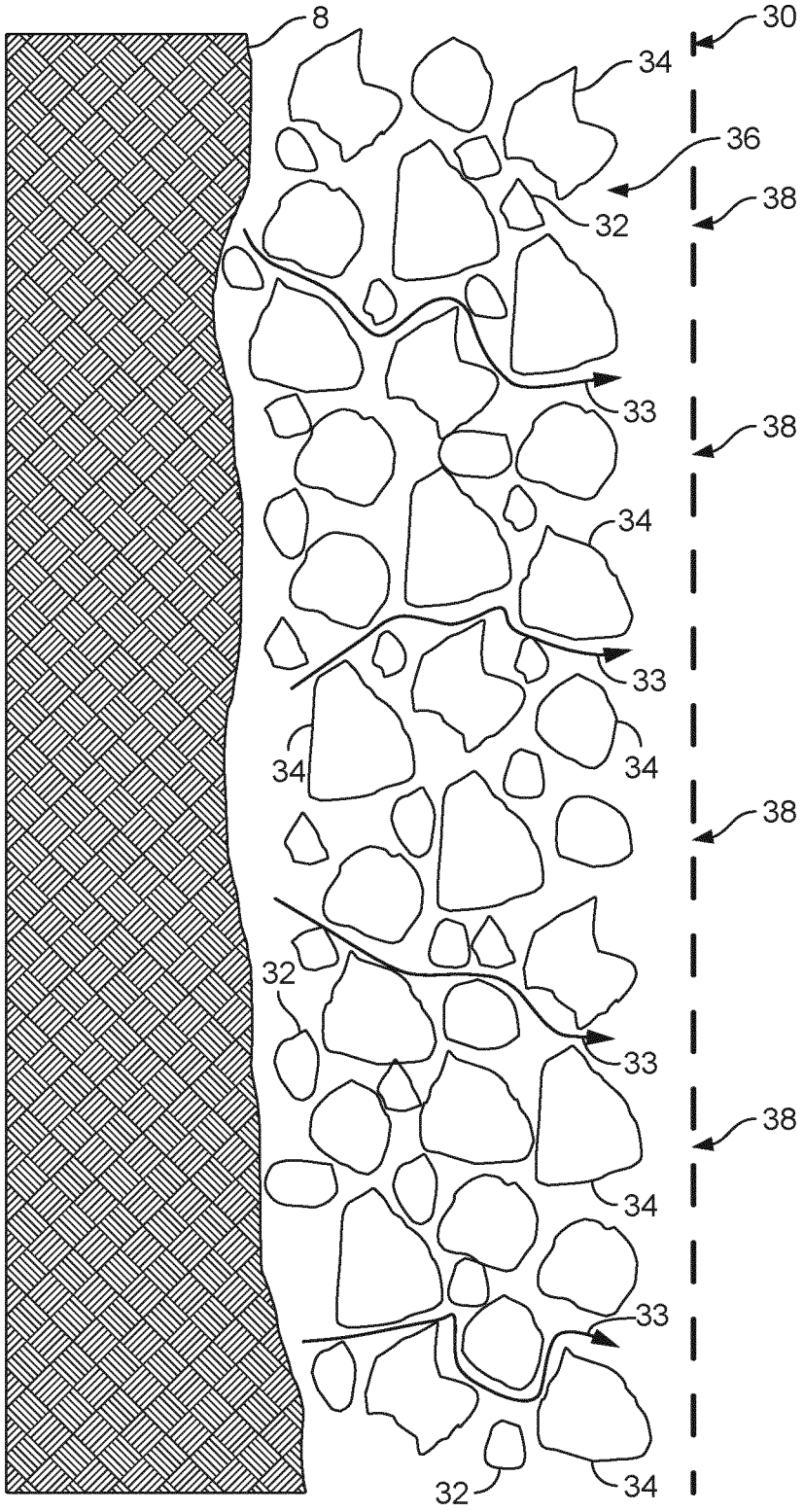
FIG. 2 is an enlarged cross-sectional view of the gravel pack of FIG. 1.

Referring now to FIG. 2, as formation fluids flow through the gravel 36 and screen assembly 30 as previously described, fines 32 carried by the formation fluids from the formation 6 may get trapped between the particles 34 forming gravel pack 36. Over time, the trapped fines 32 collect within the gravel pack 36 and may form a skin that restricts the available fluid flow paths 33 for formation fluids that extend through and between the particles 34 of gravel pack 36 and through perforations 38 in screen assembly 30. Accordingly, as the amount of fines 32 trapped or lodged within gravel pack 36 increases, the flow rate of formation fluids into screen assembly 30 and thereafter into production tubing 26 decreases. Eventually, the flow rate of formation fluids may be so low that remedial measures are taken or the well is abandoned.

Referring back to FIG. 1, to prevent or slow the formation of the skin within gravel pack 36, the drawdown pressure may be controllably adjusted over time per the methods described herein. In this embodiment, a pressure sensor (or a plurality of sensors) 13 is installed or inserted within wellbore 20 to monitor the pressure therein. Additional pressure sensors may be utilized to measure the pressure within formation 6 (and/or this value may be determined from other factors, parameters, or measurements). Thus, the drawdown pressure may be monitored via pressure sensor 13 and/or additional sensors or measurements during operations. Pressure sensor 13 is communicatively coupled to the surface 4 (particularly to controller 400) via a communication path 17. In general, the communication path 17 may include any suitable wired or wireless communication path. For example, in some examples, communication path 17 may comprise a conductive wire (e.g., electrical wire, fiber optic cable, etc.). In other examples, communication path 17 may comprise a wireless communication path (e.g., acoustic communication, radio frequency (RF) communication, infrared communication, etc.).

During operations, choke valve 14 is controllably actuated (e.g., by controller 400 in some embodiments) to adjust a flow rate of formation fluids into production conduit 16 and as a result, the drawdown pressure within wellbore 20. In other embodiments, other pressure adjusting mechanisms either in addition to or alternatively to choke valve 14 may be utilized to control or adjust the drawdown pressure within wellbore 20. For example, in some embodiments, a back pressure pump may be included within system 10 to apply a back pressure to wellbore 20 to thereby adjust a drawdown pressure within wellbore 20 during operations.

As gravel pack 36 is disposed within an area or region of wellbore 20 that includes no casing or liner (e.g., casing 22), gravel pack 36 is referred to as an open hole gravel pack. It should be appreciated that the methods discussed herein may be applied to other types of gravel pack completions, such as a cased hole gravel pack completion described above.

The following description will focus on various methods for controlling the drawdown pressure within a subterranean wellbore (e.g., wellbore 20). As previously described above, these methods are intended to manage skin within the wellbore (e.g., within gravel pack 36) so that the production of formation fluids from the subterranean wellbore may be enhanced and facilitated. In following description, continuing reference will be made to system 10 in FIG. 1; however, it should be appreciated that the following methods can be applied to wellbore systems that are different from system 10. Thus, the continued reference to system 10 should not be interpreted as limiting the application of the embodiments disclosed herein.

Figure 3:
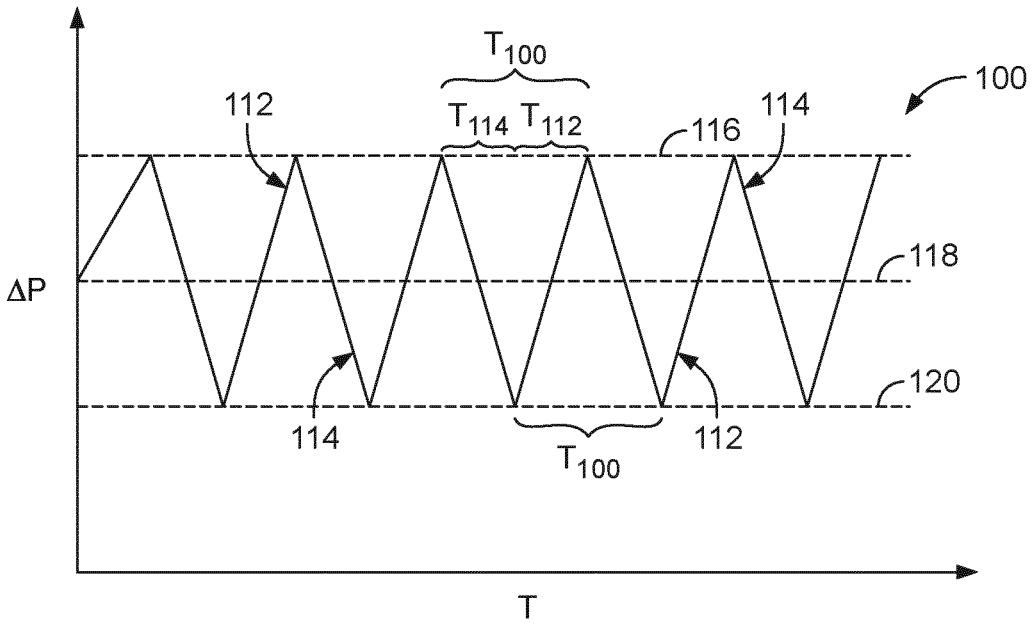
FIG. 3 is a plot illustrating a drawdown pressure oscillation for a subterranean wellbore in accordance with embodiments described herein.

Referring now to FIG. 3, a plot 100 of a controlled variation of a drawdown pressure ΔP is shown over time T for a subterranean wellbore (e.g., wellbore 20 in FIG. 1). In plot 100, the X-axis is time T, and the y-axis is the drawdown pressure ΔP. As shown in plot 100, in some embodiments, the drawdown pressure ΔP is cyclically varied about a predetermined target value 118 between an upper limit 116 and a lower limit 120. Accordingly, the drawdown pressure ΔP is oscillated in FIG. 3 about target value 118 between limits 116, 120. Referring briefly to FIGS. 1-3, when applying the drawdown pressure variation of plot 100 to system 10 previously described, the choke valve 14 and/or other pressure adjustment mechanism(s) (e.g. a back pressure pump as described above) may be actuated to achieve the desired drawdown pressure oscillations of plot 100 as previously described above.

Referring again to FIG. 3, in this embodiment, the drawdown pressure oscillations of plot 100 include a repeated pattern of alternating drawdown pressure increases 112 and drawdown pressure decreases 114. In particular, the drawdown pressure increases 112 comprise an increase in the drawdown pressure ΔP from about the lower limit 120 to about the upper limit 116, and the drawdown pressure decreases 114 comprise a decrease in the drawdown pressure from about the upper limit 116 to about the lower limit 120. The upper limit 116 may comprise an upper limit for the drawdown pressure ΔP within the wellbore 20 based on a variety of factors, such as, the pressure or flow rate limit of equipment disposed within or fluidly coupled to wellbore 20 (e.g., casing 22, tubing string 26, screen assembly 30, surface equipment 12, etc.). The lower limit 120 may be determined based on a minimum flow rate of production fluid that is desired from wellbore 20 during production operations. In some embodiments, the lower limit 120 may be sufficient to lift or flow fines (e.g., fines 32 in FIG. 2) to the surface 4. In addition, the lower limit 120 may also still be sufficient to lift produced liquid to the surface and therefore prevent liquid loading of the wellbore 20. In some specific embodiments, the amplitude (i.e., the difference between upper limit 116 and lower limit 120) of the drawdown pressure oscillations (e.g., increases 112 and decreases 114) is about less than or equal to about 30% of the target value 118, such as, for example less than or equal to 20% of the target value 118.

In this embodiment, the predetermined target value 118 may be an average of the upper limit 116 and the lower limit 118 such that the drawdown pressure increases 112 and drawdown pressure decreases 114 are evenly disposed on either side of the target value 118. As a result, in these embodiments, the target value 118 may be referred to as a mean value 118. In other embodiments, the target value 118 may be a value between the upper limit 116 and lower limit 118 that is skewed more toward upper limit 116 or lower limit 118 (such that the target value 118 is not an average or mean of the upper limit 116 and the lower limit 118). In addition, in this embodiment the target value 118 may be relatively constant over time T. However, it should be appreciated that variations within the wellbore (e.g., wellbore 20) and/or the production system (e.g., system 10) may still cause some variations in the target value 118 so that this value will not remain truly constant over time. Thus, it should be appreciated that a relatively constant target value 118 corresponds with a value that is maintained within some relatively narrow range about the intended value. For example, in some embodiments, the relatively constant target value 118 may be a value that is within +/− approximately 10-15% of the stated value. However, other percentages above 15% or below 10% are contemplated in other embodiments. In some specific embodiments, the mean value 118 may generally range from about 50 pounds per square inch (psi) to about 1500 psi.

In other embodiments, the target value 118 may gradually decrease over time due to, for example, the gradual decrease in the pressure of the formation 6 as a result of the production of formation fluids therefrom. In some of these embodiments, the upper limit 116 and lower limit 120 may be characterized as a value or percentage above and below, respectively, a target value 118. The target value 118 may gradually decrease over time due to the decrease in formation pressure previously described above, and may be determined or computed so as to provide an optimized level of production from the formation 6 during operations.

Referring still to FIG. 3, the rate or slope of each drawdown pressure increase 112 and drawdown pressure decrease 114 may be relatively equal in this embodiment. Specifically, the rate of drawdown pressure increase 112 from lower limit 120 to upper limit 116 may be generally the same as the rate of drawdown pressure decrease 114 from the upper limit 116 to the lower limit 120. In some embodiments, rate of drawdown pressure increases 112 and drawdown pressure decreases 114 may be determined by a variety of factors, such as, for example, the materials making up formation 6, the amount of skin already disposed within gravel pack 36, the stage of production, the number of producing zones within formation 6, etc. Without being limited to this or any other theory, increasing the drawdown pressure ΔP too quickly may result in a large amount of produced fines (e.g., due to an increased fluid flow rate from the formation, disaggregation of the formation rock, etc.) that cause plugging and therefore increased skin with the gravel pack (e.g., gravel pack 36). In addition, decreasing the drawdown pressure too quickly can also cause so-called cross-flow between different producing zones or depths within formation 6 (e.g., due to different rates of pressurization between separate zones of formation 6). In some specific embodiments, the rate of the drawdown pressure increases 112 and drawdown pressure decreases 114 may generally range from about 5 to about 300 psi per hour (psi/hr), or from about 5 psi/hr to about 50 psi/hr, or from about 10 psi/hr to about 20 psi/hr.

The chosen values for the upper limit 116 and lower limit 120 as well as the chosen rates of the drawdown pressure increases 112 and drawdown pressure decreases 114 ultimately contribute to a time period $T_{112}$ for each drawdown pressure increase 112, a time period $T_{114}$ for each drawdown pressure decrease 114, and a total time period $T_{100}$ of each sequentially performed drawdown pressure increase 112 and drawdown pressure decrease 114. More specifically, each time period $T_{112}$ is the time period or duration of each drawdown pressure increase 112 from about the lower limit 120 to about the upper limit 116, and each time period $T_{114}$ is the time period or duration of each drawdown pressure decrease 114 between about the upper limit 116 and about the lower limit 120. In addition, the total time period $T_{100}$ is the total time period or duration of each sequential drawdown pressure increase 112 and drawdown pressure decrease 114 or each sequential drawdown pressure decrease 114 and drawdown pressure increase 112. As previously described, because the rates of the pressure increases 112 and the drawdown pressure decreases 114 may be the same in this embodiment, the time periods $T_{112}$, $T_{114}$ may also be the same.

Referring now to FIGS. 1-3, during operations, as the drawdown pressure ΔP within system 10 is controllably oscillated through the drawdown pressure increases 112 and decreases 114 depicted within plot 100, the growth rate of skin within gravel pack 36 may be reduced or eliminated entirely (e.g., such that skin is generally prevented). In addition, in some circumstances, skin that has already formed within gravel pack 36 may also be reduced (e.g., eroded) by oscillating the drawdown pressure ΔP as shown in plot 100. Without being limited to this or any other theory, the drawdown pressure oscillations provided by the drawdown pressure increases 112 and decreases 114 may result in rearrangement and movement of the fines disposed within gravel pack 36 so that fewer fines 32 are collectively lodged therein and therefore restrict or occlude fluid flow paths 33. Specifically, during periods of increasing drawdown pressure ΔP (e.g., via drawdown pressure increases 112), the flow rate or flux of fluids (e.g., formation fluids) from formation 6 into wellbore 20 may also be increasing. The increasing flow rate may cause erosion of clusters of fines 32, thereby maintaining clean flow channels for formation fluids within gravel pack 36. Conversely, during periods of decreasing drawdown pressure ΔP (e.g., via drawdown pressure decreases 114), the flow rate or flux of the fluids (e.g., formation fluids) from formation 6 into wellbore 20 may be decreasing. As the drawdown pressure decreases the pore pressure increases, and this increase in pore pressure is believed to reduce effective stresses within the gravel pack 36 (specifically the stresses of particles within the gravel pack 36 including gravel 34 and fines 32) so that relaxation of the particles within gravel pack 36 may occur. Without being limited to any particular theory, this relaxation of the particles within gravel pack 36 may allow the continued erosion of the fines when the drawdown pressure is once again raised, so the flow channels (e.g., for formation fluids) may be opened up within gravel pack 36.

In some embodiments, the drawdown pressure ΔP may be maintained within a relatively low range during the pressure increases 112 and decreases 114. For instance, without being limited to this or any other theory, higher values of drawdown pressure ΔP may be associated with greater amount of so-called compaction within the gravel pack 36. As a result, lower values of drawdown pressure ΔP may be associated with larger pore spaces within gravel pack 36 than relatively high values of drawdown pressure ΔP.

In addition, a larger overall drawdown pressure ΔP may also result in a reduced size (e.g., diameter) of bubbles within gravel pack 36 due to a relatively high pressure of the wellbore 20 relative to the formation 6 (e.g., if the pressures within the wellbore 20 and/or formation 6 are below the bubble point of the formation fluid). Bubbles can generally block or restrict flow within the pores and flow channels of gravel pack 36, so a reduction in the size of any bubbles through gravel pack 36 may help to produce any bubbles through gravel pack 36 and/or may increase an available flow volume for formation fluids within gravel pack 36.

During the above described operations, the applied drawdown pressure oscillations may allow some of the fines 32 to proceed through perforations 38 in screen assembly 30, so that they are then produced to surface 4. Generally speaking, the production of fines 32 is not desirable (and is the reason for the gravel pack 36 placement in the first place); however, a relatively small flow rate of fines 32 into production tubing string 26 may be tolerable, especially if it also allows for a prolonged enhanced flow rate of formation fluids due to a decrease in skin. Thus, the drawdown pressure oscillations of plot 100 may enhance the production rate of formation fluids from wellbore 20 during operations by preventing and even possibly reducing skin therein.

Figure 4:
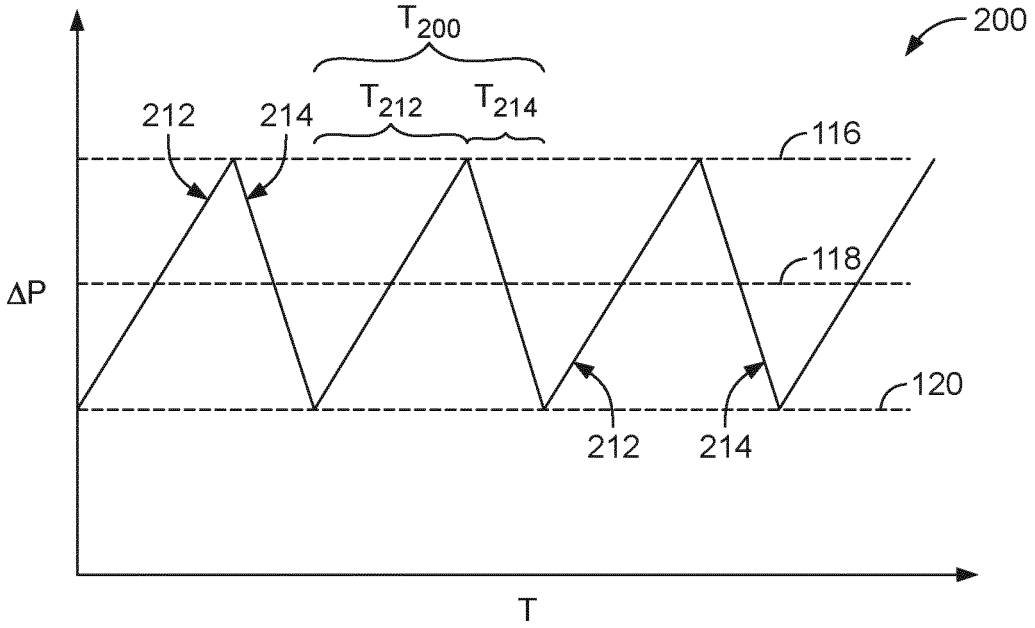
FIG. 4 is a plot illustrating another drawdown pressure oscillation for a subterranean wellbore in accordance with embodiments described herein.

Referring now to FIG. 4, another plot 200 of a controlled oscillation of drawdown pressure ΔP over time T is shown for a subterranean wellbore (e.g., wellbore 20 in FIG. 1). Plot 200 is substantially the same as plot 100, and thus, shared features and attributes of plots 100, 200 are identified with the same reference numerals, and the discussion below will focus on the features of plot 200 that are different from plot 100. Referring briefly to FIGS. 1, 2, and 4, as previously described, if the drawdown pressure variation of plot 200 is applied to system 10, the choke valve 14 and/or other pressure adjustment mechanism(s) (e.g. a back pressure pump as described above) may be actuated to achieve the desired drawdown pressure oscillations of plot 200 as previously described above.

As with plot 100, plot 200 includes a repeating pattern of successive, alternating drawdown pressure increases 212 and decreases 214 about predetermined target value 118, between upper and lower limits 116, 120. However, in this embodiment, drawdown pressure increases 212 include a generally lower rate (or more gradual slope) than the drawdown pressure decreases 214. For example, in some embodiments, the drawdown pressure decreases 214 may have a rate that is from about 1 to about 20 times, or about 10 to 20 times, the rate of the drawdown pressure increases 212. In some specific embodiments, the rate of each drawdown pressure increase 212 may range from about 5 psi/hr to about 50 psi/hr, or from about 10 psi/hr to about 20 psi/hr, and the rate of each drawdown pressure decrease 214 may range from about 5 psi/hr to about 300 psi/hr.

Accordingly, a time period $T_{212}$ of each drawdown pressure increase 212 may be generally greater than a time period $T_{214}$ of each drawdown pressure decrease 214. For example, in some embodiments the time period $T_{212}$ of each drawdown pressure increase may range from about 3 hours to about 15 hours, and the time period $T_{214}$ of each drawdown pressure decrease 214 may range from about 1 hour to about 10 hours.

Referring now to FIGS. 1, 2, and 4, as the drawdown pressure ΔP within system 10 is controllably oscillated through the drawdown pressure increases 212 and decreases 214 depicted within plot 200, the growth rate of skin within gravel pack 36 may be reduced or eliminated, and existing skin may also be reduced, in the manner previously described above. However, by including a slower rate and thus longer duration of the drawdown pressure increases 212 relative to the drawdown pressure decreases 214, the growth rate of skin may be more effectively reduced or eliminated in some circumstances. Without being limited to this or any other theory, an increasing drawdown pressure is associated with an increasing flow rate or flux of fluids from the formation and into the wellbore 20, which may promote clean channels for formation fluids through gravel pack 36 as previously described. Thus, by conducting the drawdown pressure increases 212 at a slower rate than the drawdown pressure decreases 214, more time is spent within an increasing flow rate regime, so that the benefits afforded thereby may be more pronounced over time. Thus, the drawdown pressure oscillations of plot 200 may enhance the production rate of formation fluids from wellbore 20 during operations by preventing and even possibly reducing skin therein.

Figure 5:
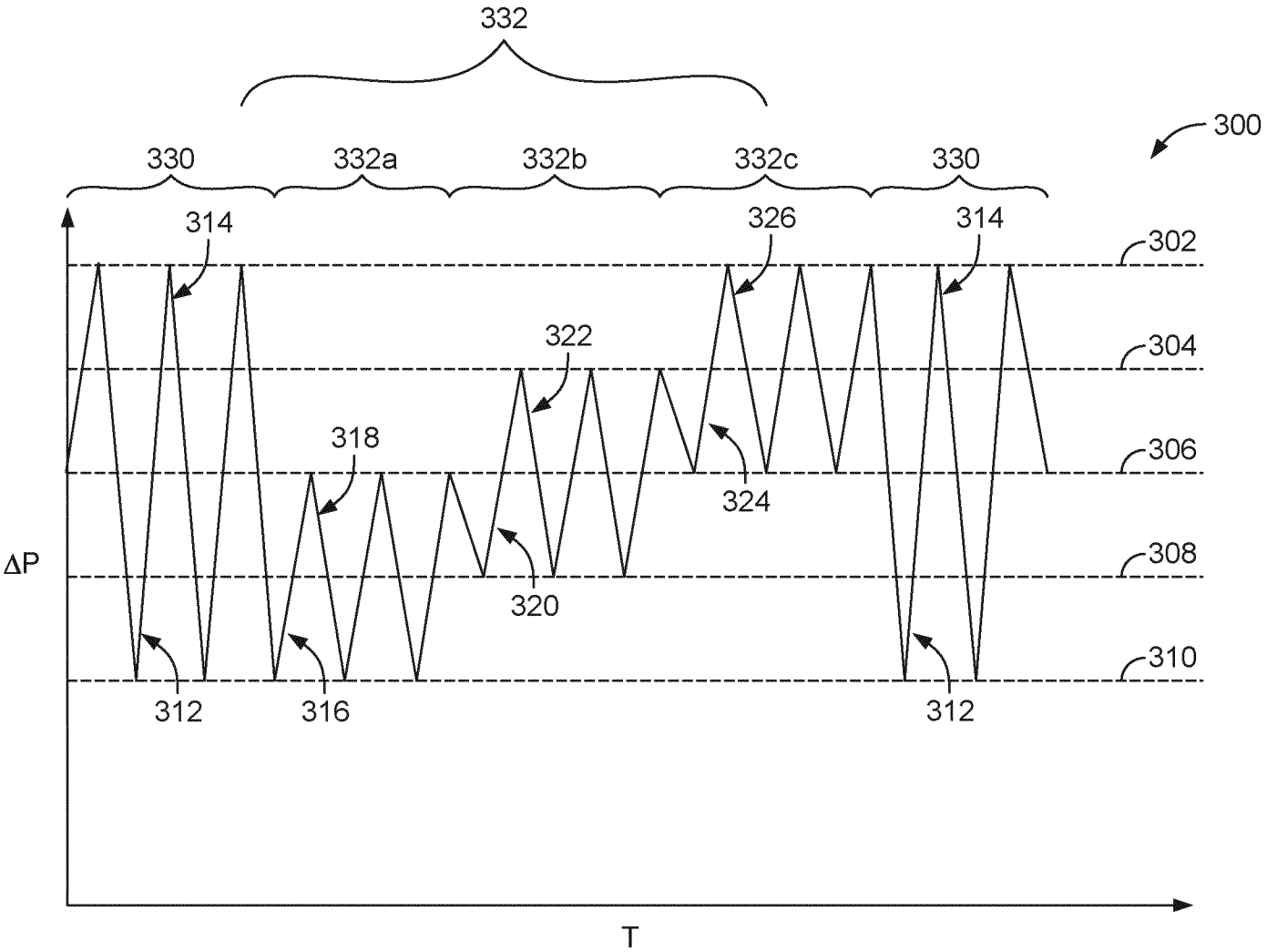
FIG. 5 is a plot illustrating another drawdown pressure oscillation for a subterranean wellbore in accordance with embodiments described herein.

While the above described drawdown pressure variations have been disposed about a substantially or relatively constant target value (e.g., such as those shown in plots 100, 200 in FIGS. 3 and 4, respectively) it should be appreciated that other embodiments may include drawdown pressure oscillations about a target value that is controllably varied over time. For example, referring now to FIG. 5, another plot 300 of controlled oscillations of drawdown pressure ΔP is shown over time T for a subterranean wellbore (e.g., wellbore 20 in FIG. 1). Referring briefly to FIGS. 1, 2, and 5, as previously described, if the drawdown pressure variation of plot 300 is applied to system 10, the choke valve 14 and/or other pressure adjustment mechanism(s) (e.g. a back pressure pump as described above) may be actuated to achieve the desired drawdown pressure oscillations of plot 300 as previously described above.

Referring specifically again to FIG. 5, in this embodiment, plot 300 shows oscillations of drawdown pressure ΔP about a selectively varied target value. Specifically, plot 300 includes repeatedly alternating between a first phase 330 and a second phase 332.

During the first phase 330, the drawdown pressure ΔP is oscillated between a plurality of drawdown pressure increases 312 and drawdown pressure decreases 314 about a predetermined target value 306. The drawdown pressure increases 312 and decreases 314 may extend between an upper limit 302 and a lower limit 310, which may be similar to the upper and lower limits disclosed above for plots 100, 200 (e.g., upper and lower limits 116 and 120, respectively). In addition, the predetermined target value 306 may be an average of the limits 302, 310 or may be skewed to one of the limits 302, 310, as similar described above for the target value 118 previously described above for plots 100, 200. Further, the drawdown pressure increases 312 and decreases 314 within the first phase may have substantially equal rates or slopes (e.g., such as shown in plot 100 for drawdown pressure increases 112 and decreases 114) or different rates or slopes (e.g., such as shown in plot 200 for drawdown pressure increases 212 and decreases 214). Thus, the descriptions above with respect to the drawdown pressure oscillations in both FIGS. 3 and 4 may be applied to describe the drawdown pressure increases and decreases 312, 314 within the first phase 330.

Referring still to FIG. 5, during the second phase 332, the drawdown pressure ΔP is oscillated about a target value that is selectively and controllably increased in a plurality of steps. In this embodiment, the target value is increased in two steps between three different values; however, the number of steps may be varied in other embodiments. Specifically, in this embodiment the drawdown pressure ΔP is varied within a first plurality of oscillations 332*a*, between drawdown pressure increases 316 and decreases 318 about a predetermined target value 308. Then, the drawdown pressure ΔP is varied within a second plurality of oscillations 332*b*, between drawdown pressure increases 320 and decreases 322 about predetermined target value 306. Finally, the drawdown pressure ΔP is varied within a third plurality of oscillations 332*c*, between drawdown pressure increases 324 and decreases 326 about a predetermined target value 304.

The target value 304 is greater than the target value 306, and the target value 306 is greater than the target value 308. In addition, in this embodiment the target value 306 associated with the increases and decreases 320 and 322, respectively, is substantially equal to the target value 306 associated with the increases and decreases 312, 314 in the first phase 330.

Referring still to FIG. 5, the drawdown pressure ΔP increases and decreases 316 and 318, respectively, within the first plurality of oscillations 332*a* may extend approximately between a lower limit 310 and an upper limit 306. Thus, in this embodiment, lower limit 310 of the first plurality of drawdown pressure oscillations 332*a* may be substantially equal to the lower limit of the drawdown pressure oscillations (e.g., the increases 312 and decreases 314) during the first phase 330, and the upper limit 306 of the first plurality of drawdown pressure oscillations 332*a* may be substantially equal to the target value of the drawdown pressure oscillations during the first phase 330.

Within the second plurality of oscillations 332*b*, the drawdown pressure ΔP increases 320 and decreases 322 extend approximately between a lower limit 308 and an upper limit 304. Thus, in this embodiment, the upper limit 304 of second plurality of oscillations 332*b* is substantially equal to the target value of the third plurality of oscillations 332*c*, and the lower limit 308 of the second plurality of oscillations 332*b* is substantially equal to the target value of the first plurality of oscillations 332*a*.

Within the third plurality of oscillations 332*c*, the drawdown pressure ΔP increases 324 and decreases 326 extend approximately between an upper limit 302 and a lower limit 306. Thus, in this embodiment, the lower limit 306 of the third plurality of oscillations 332*c* is substantially equal to the upper limit of the first plurality of oscillations 332*a* and the target value of the drawdown pressure oscillations within the first phase 330. In addition, the upper limit 302 of the third plurality oscillations 332*c* is substantially equal to the upper limit of the drawdown pressure oscillations within the first phase 330.

It should be appreciated that the various, previously described equivalences between the target values, upper limits, and lower limits of the first phase 330 and second phase 332 are a feature of only some embodiments, such as, the embodiment FIG. 5. Thus, in other embodiments, such equivalence (or approximate equivalence) is not achieved between all or any of the target values, upper limits, and lower limits of the drawdown pressure oscillations within each of the first phase 330 and second phase 332. In addition, even within the embodiment of FIG. 5, variances in the drawdown pressure ΔP during operations may mean that the actual practiced target values, upper limits, and lower limits may not have the same equivalences discussed above for the idealized case depicted in FIG. 5. Therefore, the above described equivalences should not be interpreted as limiting the scope of the general principles disclosed herein with respect to the drawdown pressure oscillations.

Referring still to FIG. 5, the drawdown pressure oscillations 332*a*, 332*b*, 332*c* within the second phase 332 may vary about the corresponding target values 308, 306, 304, respectively, in a similar fashion to that described above for the plots 100, 200. For example, the target values 308, 306, 304 may be an average of the corresponding upper and lower limits 306 and 310, 304 and 308, and 302 and 306, respectively, or may be skewed closer to one of the corresponding upper and lower limits 306 and 310, 304 and 308, and 302 and 306, respectively. In addition, the various drawdown pressure increases 316, 320, 324 and decreases 318, 322, 326, of the oscillations 332*a*, 332*b*, 332*c*, respectively, may have substantially equal rates or slopes (e.g., such as shown in plot 100 for drawdown pressure increases 112 and decreases 114) or different rates or slopes (e.g., such as shown in plot 200 for drawdown pressure increases 212 and decreases 214).

Referring now to FIGS. 1, 2, and 5, as the drawdown pressure ΔP within system 10 is controllably oscillated per plot 300, the growth rate of skin within gravel pack 36 may be reduced or eliminated, and existing skin may also be reduced, in the manner previously described above. However, by varying the target value and limits of oscillation to alternate the drawdown pressure oscillations between the first and second phases 330, 332, respectively, as described above, skin may be more effectively prevented or reduced in some circumstances.

In particular, without being limited to this or any other theory, the first phase 330 includes the relatively wider drawdown pressure oscillations of the increases 312 and decreases 314 than the drawdown pressure oscillations 332*a*, 332*b*, 332*c* in the second phase 332. Stated another way, the drawdown pressure oscillations within the first phase 330 may have a larger amplitude than the drawdown pressure oscillations in the second phase 332 (e.g., oscillations 332*a*, 332*b*, 332*c*). For example, in some particular embodiments, the drawdown pressure oscillations within the first phase 330 may be have an amplitude of approximately 200 psi, whereas the first, second, and third pluralities of oscillations 332*a*, 332*b*, 332*c*, respectively, in the second phase may each have an amplitude of approximately 40 psi. The wider pressure oscillations within the first phase 330 may allow for a greater or more aggressive fluid flow rate or flux variance within the gravel pack 36 so that conglomerated fines 32 within gravel pack 36 may be eroded to open channels within gravel pack 36 (particularly within a skin formed therein) and allow for an enhanced flow rate of formation fluids therethrough. To further enhance the erosive effects, in some embodiments, the duration of the drawdown pressure increases 312 may be increased relatively to the duration of the drawdown pressure decreases 314 in the same or similar manner to that described above for increases 212 and decreases 214 within plot 200.

In addition, without being limited to this or any other theory, the progressively increasing target values associated with the oscillations 332*a*, 332*b*, 332*c* within the second phase 332 may provide for an initial relaxation of particles (e.g., during the first plurality of oscillations 332*a*) followed by an increasing fluid flow rate or flux variances (e.g., during the second and third pluralities of oscillations 332*c*, 332*d*) thereafter. Specifically, the drawdown pressure ΔP is generally lowered when the transition is made between the drawdown pressure oscillations within the first phase 330 to the first plurality of drawdown pressure oscillations 332*a*, which may provide a decreased or lowered stress on the particles within gravel pack 36 (including gravel 34 and fines 32). As a result, the particles within gravel pack 36 may rearrange to open or widen channels therein. Thereafter, as the drawdown pressure ΔP is varied within the second plurality of oscillations 332*b* and then the third plurality of oscillations 332*c*, the drawdown pressure ΔP variances are generally increased from the first plurality of oscillations 332*a* such that the fluid flux is generally increased on the particles within gravel pack 36 and erosion of these new or widened channels may take place. Thus, the reduction in the effective stress and the subsequent erosion of particles as the fluid lux is gradually increased within gravel pack 36 during the first, second, and third plurality of oscillations, 332*a*, 332*b*, and 332*c*, respectively, may further enhance the flow of production fluid from formation 6 into wellbore 20.

In addition, the general increases in drawdown pressure ΔP variance in the second and third plurality of oscillations 332*b* and 332*c*, respectively, may also allow the erosive effects to progressively reach farther and farther out from the screen assembly 30. In particular, the generally progressively increasing drawdown pressure ΔP variances with the first plurality oscillations 332*b* and the second plurality of oscillations 332*c* are also associated with generally progressively increasing fluid flow rate or flux as previously described above. As the fluid flow rate or flux through the gravel pack 36 generally, progressively increases during the second plurality of oscillations 332*b* and the third plurality of oscillations 332*d*, the erosion of channels within the gravel pack 36 occurs progressively farther and farther outward from screen assembly 30 toward and into formation 6. By commencing with the plurality of oscillations 332*a* within second phase 332, clear channels are formed in the gravel pack 36 that provide space for further fines liberated during the plurality of oscillations 332*b* and 332*c* to be produced to the surface (e.g., surface 4). Following the third plurality of oscillations 332*c* within the second phase 332, the drawdown pressure ΔP is once again oscillated between the more aggressive drawdown pressure increases 312 and decreases 314 of the first phase 330 to further enhance the erosion of channels within gravel pack 36 as previously described above.

Also, oscillations at the generally reduced drawdown pressures ΔP in the first plurality of oscillations 332*a* of the second phase may also reduce the size of gas bubbles that are trapped within the gravel pack 36 (e.g., for situations where the pressure within the gravel pack 36 is below the bubble point of the hydrocarbons emitted from formation 6). Specifically, as previously described, a relatively elevated drawdown pressure ΔP is associated with a relatively low wellbore pressure (since the drawdown pressure ΔP is the difference between the formation pressure and wellbore pressure as previously described above). Thus, at elevated drawdown pressures ΔP (e.g., such as those associated with the drawdown pressure increases 312 and drawdown pressure decreases 314 of the first phase 330), large gas bubbles may form (e.g., bubbles of hydrocarbon gas produced from formation 6) that are lodged within the gravel pack 32 and therefore occlude or restrict fluid flow channels therein. However, by oscillating the drawdown pressure ΔP at the relatively lower values of the first plurality oscillations 332*a*, the generally increased pressure within wellbore 20 (which is associated with a lower drawdown pressures ΔP) reduces the size of any trapped bubbles within gravel pack 36. Reducing the size of the trapped bubbles provides additional space for clean channels to open up, thereby allowing the production of skin-forming fines to the surface (e.g., surface 4). As a result, during the subsequent oscillations of the drawdown pressure ΔP within the second and third plurality of oscillations 332*b* and 332*c*, respectively, these newly cleared channels allow for enhanced flow of productions fluids into screen assembly 30.

Referring again to FIG. 5, in some embodiments, the decision of when to switch between the first phase 330 and the second phase 332 (or even when to switch between the different oscillations 332*a*, 332*b*, 332*c* within the second phase 332) may be based on a predetermined timing schedule. For example, in some embodiments, the first phase 330 may be conducted over a time period ranging from about 1 to 10 days, and the second phase 332 may be conducted over a time period ranging from about 1 to 30 days. In some embodiments, the duration of the first phase 330 may be increased relative to the duration of the second phase 332 so as to maximize the amount of time that the more aggressive oscillations in drawdown pressure ΔP from the first phase 330 (e.g., drawdown pressure increases 312 and decreases 314) are applied within the wellbore (e.g., wellbore 20), to more fully realize the erosive benefits described above.

In addition, within each second phase 332, each successive drawdown pressure oscillation 332*a*, 332*b*, 332*c* may be conducted over a time period ranging from about 1 to about 10 days. In some embodiments, the duration of each of the drawdown pressure oscillations 332*a*, 332*b*, 332*c* are substantially equal. However, in other embodiments, the durations of one or more (including all) of the drawdown pressure oscillations 332*a*, 332*b*, 332*c* may be different than the other drawdown pressure oscillations during the second phase 332.

Further, in other embodiments, the decision of when to switch between an first phase 330 and a second phase 332 (or even when to switch between the different oscillations 332*a*, 332*b*, 332*c* within the second phase 332) may be made by monitoring one or more parameters of the wellbore 20 or system 10. For example, in some embodiments, the flow rate of formation fluid and/or the pressure of the wellbore (e.g., wellbore 20) may indicate that the effectiveness of the current drawdown pressure oscillation pattern has been diminished thereby leading personnel (or a controller as described below) to conclude that it is time to adjust the drawdown pressure oscillation pattern (e.g., such as an adjustment associated with changing from the first phase 330 to a second phase 332 or to change between the different oscillations 332*a*, 332*b*, 332*c* within the second phase 332). Specifically, if the current oscillation pattern is effective at reducing skin within the wellbore 20, the formation fluid flow rate into the wellbore 20 may increase, which also causes an increase in the wellbore pressure 20. Thus, if the value of the formation fluid flow rate or the pressure of the wellbore 20 is increasing, the decision may be made (again by personnel and/or a controller) to maintain the current oscillation pattern. However, once the formation fluid flow rate and/or pressure of the wellbore 20 plateaus or decreases, a decision may be made to switch from the current oscillation pattern to a new oscillation pattern, which may involve a change between the first phase 330 and second phase 332 or between oscillations 332*a*, 332*b*, 332*c* of the second phase 332 as previously described above.

Figure 6:
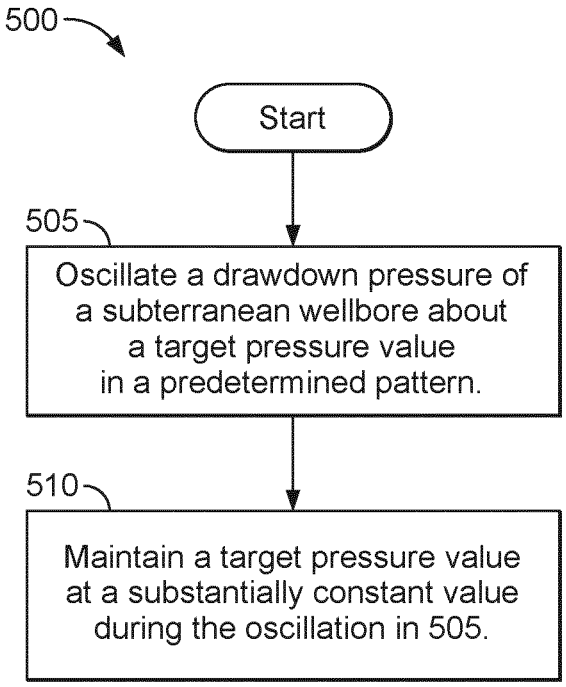
FIGS. 6 and 7 are schematic flowcharts illustrating embodiments of methods for managing skin formation within a subterranean wellbore in accordance with principles described herein.

Referring now to FIG. 6, a method 500 of managing skin within a subterranean wellbore is shown. Method 500 may be practiced with any suitable subterranean wellbore, such as, for example a subterranean wellbore that has undergone a gravel pack completion process (e.g., wellbore 20), a stand-alone screen completion process, etc. In the following description, method 500 will be described within the context of system 10 and the pressure plots 100, 200, previously described. However, such specific reference should not be interpreted as limiting the application of method 500. In addition, in some embodiments, method 500 may be wholly or partially practiced with a controller (e.g., controller 400 described below).

Initially, method 500 begins by oscillating a drawdown pressure of a subterranean wellbore (e.g., wellbore 20) about a predetermined target drawdown pressure value in a predetermined pattern at block 505. In particular, the predetermined pattern of oscillations at block 505 may be similar to the oscillations described above and shown in plots 100, 200 (see FIGS. 3 and 4). Thus, the oscillations at block 505 may include increasing a drawdown pressure from a lower limit to an upper limit, and then decreasing the drawdown pressure from the upper limit to the lower limit (e.g., lower limit 120 and upper limit 116 shown in FIGS. 3 and 4). In some embodiments, the oscillations at 505 may include increasing the drawdown pressure at a first rate and then decreasing the drawdown pressure at a second rate that is different from the first rate. In particular, in some embodiments, the second rate may be greater than the first rate (e.g., such as is shown in FIG. 3 for plot 100). In other embodiments, the oscillations at block 505 may include increasing the drawdown pressure at a first rate and then decreasing the drawdown pressure at the first rate (e.g., such as is shown in FIG. 4 for plot 200).

Next, method 500 includes, at block 510, maintaining the target drawdown pressure value at a substantially constant value during the oscillation at block 505. For example, maintaining a substantially constant value for the target drawdown pressure value may include maintaining the target drawdown pressure value within a defined range, such as that describe above for the target value 118 in plot 100.

Figure 7:
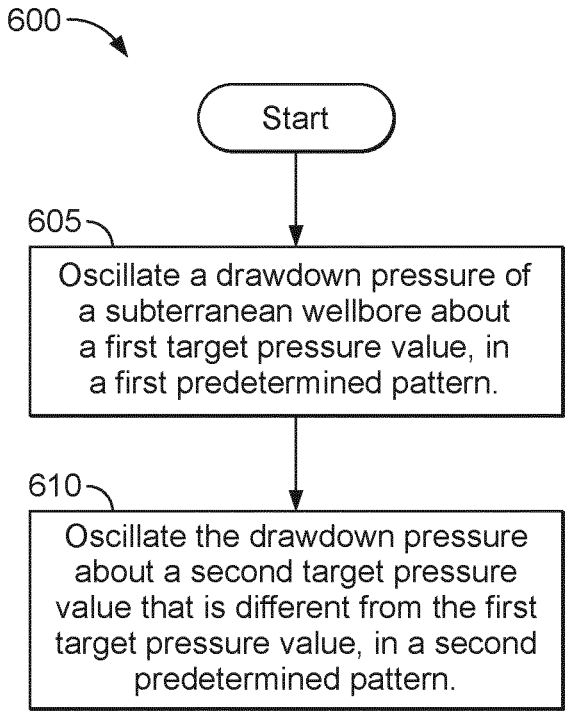

Referring now to FIG. 7, another method 600 of managing skin within a subterranean wellbore is shown. Method 600 may be practiced with any suitable subterranean wellbore, such as, for example, a subterranean wellbore that has undergone a gravel pack completion process (e.g., wellbore 20). In the following description, method 600 will be described within the context of system 10 and the pressure plot 300, previously described. However, such specific reference should not be interpreted as limiting the application of method 600. In addition, in some embodiments, method 600 may be wholly or partially practiced with a controller (e.g., controller 400 described below).

Initially, method 600 begins by oscillating a drawdown pressure of a subterranean wellbore (e.g., wellbore 20) about a first predetermined target value, in a first predetermined pattern at block 605. Next, method 600 includes oscillating the drawdown pressure of the subterranean wellbore at a second predetermined target value that is different than the first target drawdown pressure value, in a second predetermined pattern at block 610.

The second target drawdown pressure value may be greater than or less than the first target drawdown pressure value. For example, blocks 605, 610 of method 600 may correspond with the changing or shifting from the first phase 330 to the second phase 332, or with the changing or shifting between the different oscillations 332*a*, 332*b*, 332*c* of the second phase 332 in plot 300 of FIG. 5. In addition, in some embodiments, method 600 may also include oscillating the drawdown pressure about the second target value at block 610 after a predetermined period of time has elapsed since oscillating the drawdown pressure about the first target value at block 605. Further, in some embodiments, method 600 may also include oscillating the drawdown pressure about the second target value at block 610 after oscillating the drawdown pressure about the first target value based on a measurement of a pressure within the wellbore and/or a flow rate of formation fluids within the wellbore.

In addition, the first and second predetermined patterns of oscillations at blocks 605 and 610, respectively, may be similar to the oscillations described above and shown in plots 100, 200, 300 (see FIGS. 3-5). Thus, the oscillations at blocks 605, 610 may include increasing a drawdown pressure from a corresponding lower limit to corresponding upper limit, and then decreasing the drawdown pressure from the corresponding upper limit to the corresponding lower limit (e.g., lower limit 120 and upper limit 116 shown in FIGS. 3 and 4, or the limits 302, 304, 306, 308, 310, etc. shown in FIG. 5). In some embodiments, the first and/or second predetermined patterns of oscillations at 605 and 610, respectively, may include increasing the drawdown pressure at a first rate and then decreasing the drawdown pressure at a second rate that is different from the first rate. In particular, in some embodiments, the second rate may be greater than the first rate (e.g., such as is shown in FIG. 3 for plot 100). In other embodiments, the first and/or second predetermined patterns of oscillations at 605 and 610, respectively, may include increasing the drawdown pressure at a first rate and then decreasing the drawdown pressure at the first rate (e.g., such as is shown in FIG. 4 for plot 200).

Referring again to FIG. 1, system 10 may further include a controller 400 that is coupled to choke valve 14 (and/or any other pressure adjustment mechanisms that are included within system 10), and is configured to adjust the position of choke valve 14 to control the drawdown pressure of wellbore in the manner described above (e.g., such as described above for plots 100, 200, 300, etc.). Controller 400 may be incorporated within a larger control device or assembly, such as, for example, a control device or assembly for controlling system 10 more generally, or may be a standalone control unit for performing the functions described herein. In addition, as previously described above, controller 400 may be located at surface 4 proximate or on surface equipment 4, or may be located remotely to system 10 (e.g., such as a central office or control station that is communicatively coupled to system 10). Generally speaking, controller 400 includes a processor 402 and a memory 404.

Processor 402 (e.g., microprocessor, central processing unit, or collection of such processor devices, etc.) executes machine-readable instructions (e.g., software) provided on memory 404, and upon executing the machine-readable instructions on memory 404 provides the controller 400 with all of the functionality described herein. Memory 404 may comprise volatile storage (e.g., random access memory), non-volatile storage (e.g., flash storage, read only memory, etc.), or combinations of both volatile and non-volatile storage. Data consumed or produced by the processor 402 when executing the machine-readable instructions can also be stored on memory 404. The memory 404 may comprise non-transitory machine-readable medium.

During operations, controller 400 (via the machine readable instructions executed by processor 402) may controllably actuate choke valve 14 (and/or a back pressure pump or other pressure adjustment mechanism within system 10) to adjust the drawdown pressure of wellbore 20. In particular, controller 400 may selectively vary the drawdown pressure within wellbore 20 via any of the embodiments and methods described above (e.g., such as shown in plots 100, 200, 300, or described above for methods 500, 600, etc.). In other embodiments, controller 400 may alert personnel (e.g., via a display device or other method) that a particular actuation of the choke valve 14 (and/or some other pressure adjustment mechanism) is desirable, so as, for example to allow the drawdown pressure of wellbore 20 to varying in a manner described above (e.g., such as shown in plots 100, 200, 300). The controller 400 may selectively adjust the drawdown pressure (or alert personnel to a desirable change in drawdown pressure) based on a predetermined timing schedule or based on one or more measured or derived or calculated parameters as previously described above (e.g., the pressure within wellbore 20, flow rate of formation fluids, etc.). As a result, processor 402 may periodically capture a pressure reading from the sensor 13 (or one or more other sensors disposed throughout system 10) while or in advance of performing the functions discussed above.

The various previously described oscillations in drawdown pressure may be performed throughout the entire lifespan of a well or may be utilized only during certain periods or times. For example, the drawdown pressure oscillations described above (e.g., such as shown in plots 100, 200, 300, etc.), may be utilized immediately or shortly after the gravel pack completion operation has completed, in order to facilitate the so called "clean-up" of fines (e.g., fines 32) that may be disposed within the gravel pack 36 as a result of the completion operations themselves. In addition, the drawdown pressure oscillations described above may be utilized during normal production operations following the clean-up period. Further, in some embodiments, one embodiment or type of oscillations (e.g., such as one of the oscillation patterns shown in plots 100, 200, 300, etc.) may be utilized during the clean-up period described above, while another embodiment or type of the oscillations may then be utilized during subsequent production operations after the clean-up period. Still further, in some embodiments, a plurality of different oscillation patterns (e.g., such as the oscillation patterns shown in plots 100, 200, 300) may be utilized for the drawdown pressure during clean-up and/or during the production operations.

Therefore, by selectively oscillating the drawdown pressure of a gravel packed 36 subterranean wellbore (e.g., wellbore 20), skin formed within the gravel pack (e.g., skin formed by fines 32 within gravel pack 36) may be prevented, reduced, or eliminated. As a result, through use of the drawdown pressure oscillation methods described herein, the flow rate of formation fluids form the subterranean wellbore may be enhanced so that the overall productivity of the well may be increased.

The plots of the drawdown pressure variations discussed above have included substantially linear variations in the drawdown pressure $\Delta P$ (e.g., plots 100, 200, 300, etc.). However, it should be appreciated that in other embodiments, the drawdown pressure $\Delta P$ may be varied in a substantially non-linear fashion. For example, in some embodiments, the drawdown pressure $\Delta P$ may be oscillated in a sinusoidal (or substantially sinusoidal) pattern or profile about a target value. In addition, in some embodiments, the variations in drawdown pressure $\Delta P$ may comprise a superposition of two wave patterns, such as, for example two sine wave patterns.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

To further illustrate various embodiments, the following examples are provided. However, it should be appreciated that embodiments disclosed herein are not limited to the following examples.

Example 1

Figure 8:
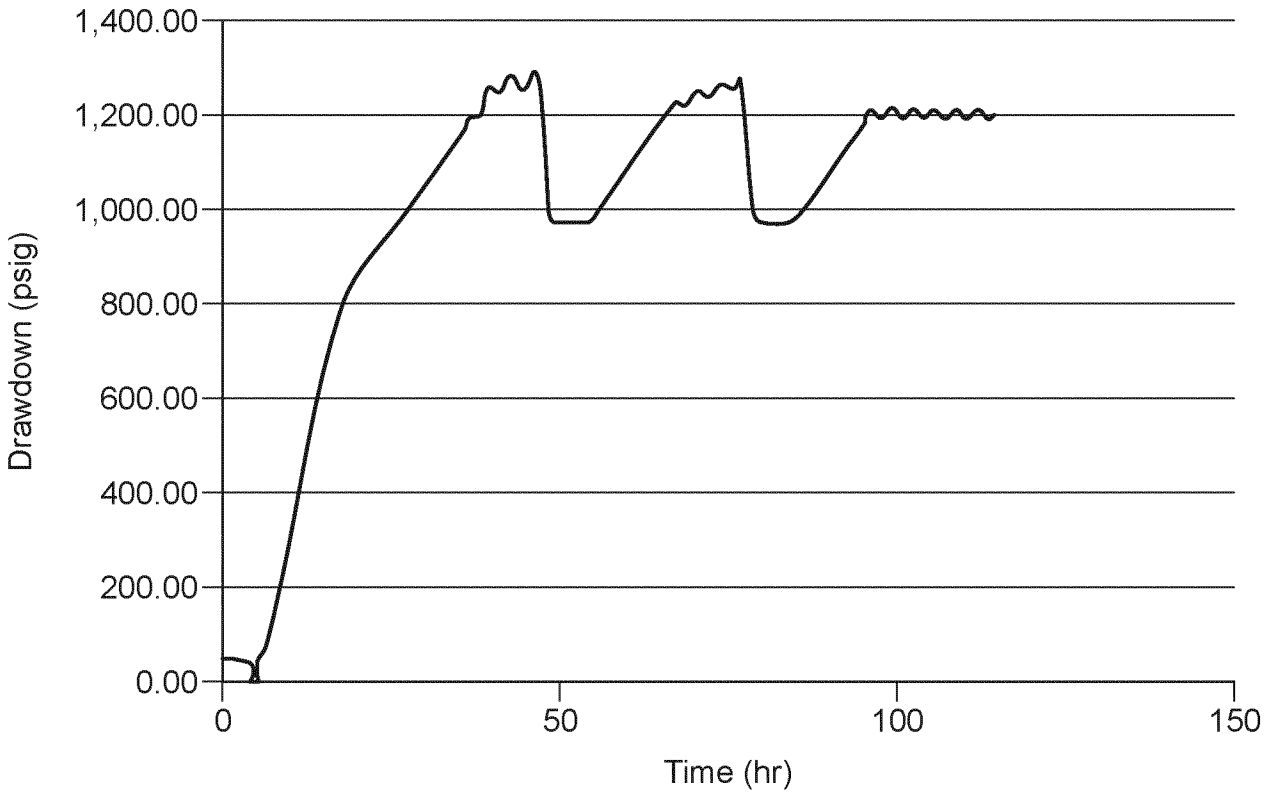
FIG. 8 is a plot of drawdown pressure as a function of time according to Example 1 discussed below.

Within a wellbore, the drawdown pressure was oscillated along a pattern shown in FIG. 8 which included a repeating oscillation between approximately 1250 psig and approximately 1000 psig over a period of approximately 50 hours. These oscillations resulted in an increase of approximately 250 bbl/d in the oil production rate (which amounted to an increase of approximately 4.5% of total production).

Example 2

Figure 9:
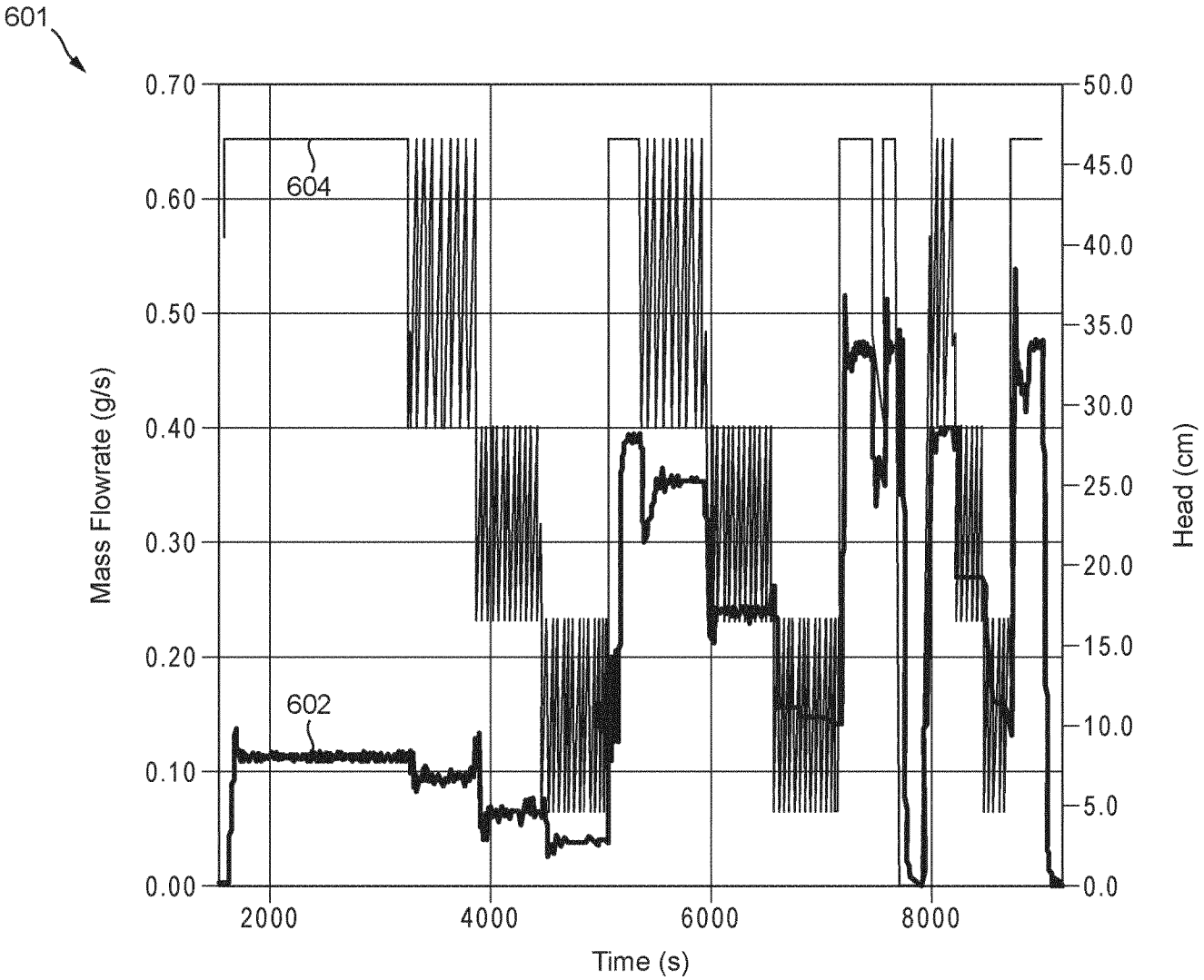
FIG. 9 is a combined plot of mass flowrate and pressure head as a function of function of time for the experiment described in Example 2 discussed below.
Figure 10:
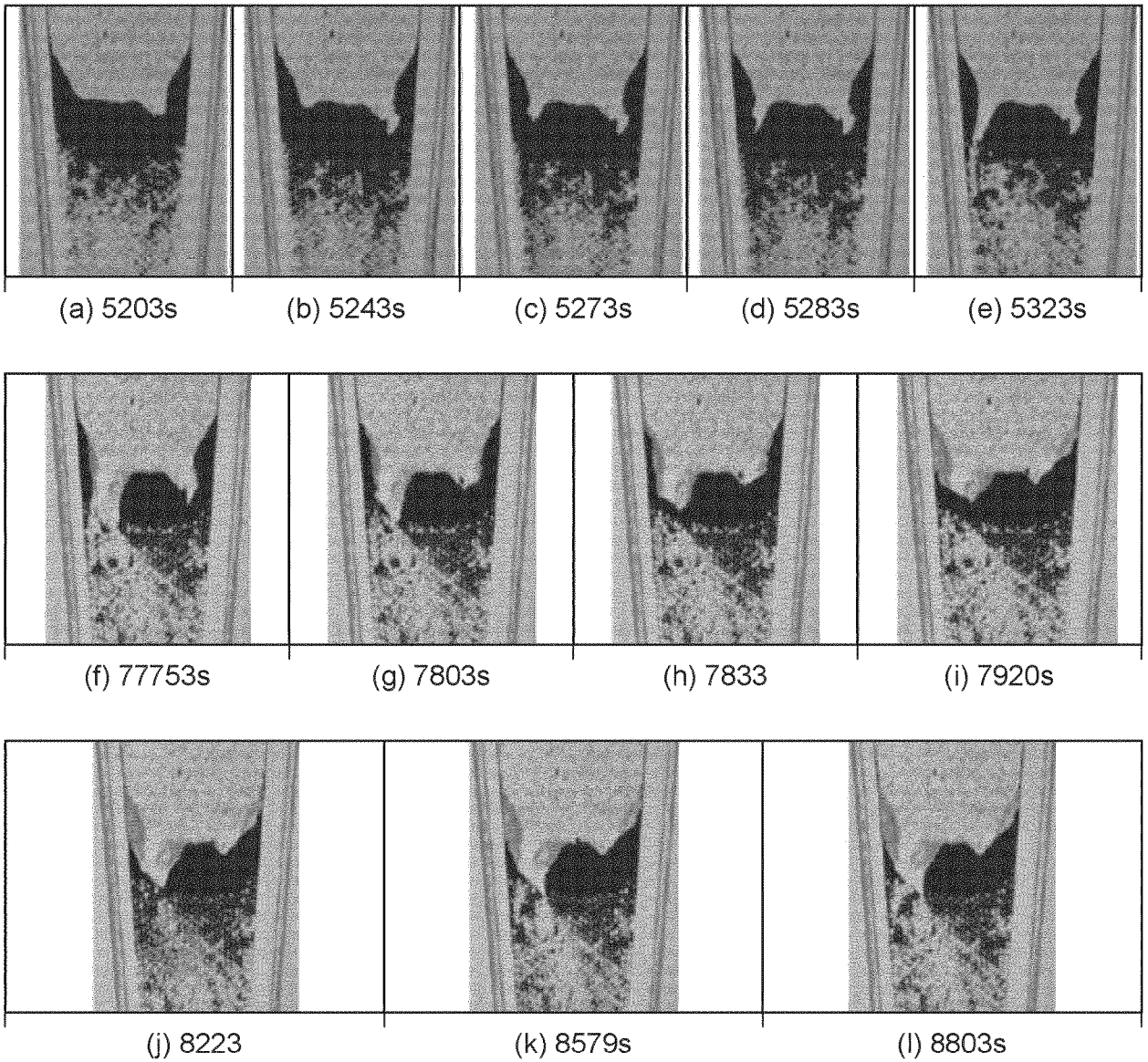
FIGS. 10(*a*)-10(*l*) are photographs of a tapered cell, with gravel and fine particles disposed therein, during the experiment described in Example 2 discussed below.

A tapered transparent cell was constructed, and a layer of transparent gravel particles was inserted therein. In addition, a layer of dark fine particles with a mean diameter that is $1/20^{th}$ of the transparent gravel particles were inserted on top of the transparent gravel to represent the entrapment of fine particles that constitute an established skin. A pressure head was then exerted across the layers of fine particles and transparent gravel to drive the fine particles into the gravel. FIG. 9 is a combined plot 601 of the mass flowrate 602, in gallons per second (g/s), flowing out of the transparent cell and the magnitude of the applied pressure head 604, in cm, within the transparent cell as a function of time, in seconds (s). Similarly, FIGS. 10(*a*)-10(*l*) show pictures of the gravel and fine particles within the tapered cell at various points in time during the experiment.

As shown in the plot of FIG. 9, for an initial phase from 2000 seconds to approximately 3250 seconds, the induced pressure head was kept constant at a value of approximately 45 cm. During this phase, there was little to no movement of the fine particles through the gravel, and a fluid flow rate of 0.12 g/s was observed through the transparent cell. Then at approximately 3250 seconds, a cycling of the pressure head was induced whereby the head was oscillated within a first pattern between approximately 45 cm and approximately 30 cm, then a second pattern between approximately 30 cm and approximately 17.5 cm, and finally a third pattern between approximately 17.5 cm and approximately 5 cm. This overall pattern of oscillations was repeated a total of three times. During the course of the experiment, the fine dark particles were produced through the transparent gravel, such that skin was reduced. As a result, the flow rate of fine particles increased four-fold from an initial approximate 0.12 g/s at about 2000 s to measurements of approximately 0.48 g/s at about 7500-8500 s. In addition, as can be appreciated from the views in FIGS. 10(*a*)-10(*l*), the fine particles were generally eroded and produced through the transparent gravel during the course of the cyclical oscillations shown in the plot of FIG. 9.

What is claimed is:

1. A method of managing skin within a subterranean wellbore, the method comprising:

(a) adjusting a flowrate of formation fluids flowing through an interior of a production tubing located in the subterranean wellbore, and (b) oscillating a drawdown pressure of the subterranean wellbore in a predetermined pattern in response to adjusting the flowrate of the formation fluids flowing through the interior of the production tubing, wherein the oscillation in the drawdown pressure comprises a plurality of alternating drawdown pressure increases and drawdown pressure decreases, wherein the drawdown pressure increases of the predetermined pattern comprise increasing the drawdown pressure at a first rate, and wherein the drawdown pressure decreases of the predetermined pattern comprise decreasing the drawdown pressure at a second rate that is different from the first rate.

2. The method of claim 1, wherein the second rate is greater than the first rate.

3. The method of claim 2, wherein the second rate is about 10 to about 20 times the first rate.

4. The method of claim 2, wherein the first rate is about 10 pounds per square inch per hour (psi/hr) to about 20 psi/hr.

5. The method of claim 1, wherein (b) comprises oscillating the drawdown pressure about a first predetermined target value; and wherein the method further comprises:

(c) oscillating the drawdown pressure about a second predetermined target value after (c) that is different from the first target value, in a second predetermined pattern.

6. The method of claim 5, comprising:

maintaining the first predetermined target value substantially constant during (b); and maintaining the second predetermined target value substantially constant during (c).

7. The method of claim 5, wherein (b) comprises oscillating the drawdown pressure between an upper and a lower limit about the first predetermined target value, and optionally wherein the first predetermined target value is an average of the upper limit and the lower limit.

8. The method of claim 5, further comprising:

(d) oscillating the drawdown pressure about a third predetermined target value after (c); and (e) oscillating the drawdown pressure about a fourth predetermined target value after (d), wherein the fourth predetermined target value is greater than the third predetermined target value, and the third predetermined target value is greater than the second predetermined target value.

9. The method of claim 8, further comprising:

wherein the oscillating in (b) comprises a first amplitude, the oscillating in (c) comprises a second amplitude, the oscillating in (d) comprises a third amplitude, and the oscillating in (e) comprises a fourth amplitude, and wherein the first amplitude is greater than the second amplitude, the third amplitude, and the fourth amplitude.

10. The method of claim 9, further comprising repeating (b), (c), (d) and (e).

11. A system for producing hydrocarbons from a subterranean wellbore, the system comprising:

a production tubing installed within the wellbore;

a choke valve fluidly coupled to the production tubing such that formation fluids that flow into the wellbore are communicated to the choke valve via the production tubing; and a controller coupled to the choked valve, wherein the controller is configured to selectively actuate the choke valve to:

(a) adjust a flowrate of formation fluids flowing through an interior of the production tubing located in the subterranean wellbore; and (b) oscillate a drawdown pressure of the wellbore in a predetermined pattern in response to adjusting the flowrate of the formation fluids flowing through the interior of the production tubing, wherein the oscillation in the drawdown pressure comprises a plurality of alternating drawdown pressure increases and drawdown pressure decreases, wherein the drawdown pressure increases of the predetermined pattern comprise increases of the drawdown pressure at a first rate, and wherein the drawdown pressure decreases of the predetermined pattern comprise decreases of the drawdown pressure at a second rate that is different from the first rate.

12. The system of claim 11, wherein the second rate is greater than the first rate.

13. The system of claim 12, wherein the second rate is about 10 to about 20 times the first rate.

14. The system of claim 11, wherein the controller is configured to oscillate the drawdown pressure about a first target value during (b), and wherein the controller is configured to:

(c) oscillate the drawdown pressure about a second predetermined target value after (b) that is different form the first target value, in a second predetermined pattern.

15. The system of claim 14, wherein the controller is further configured to:

(d) oscillate the drawdown pressure about a third predetermined target value after (c); and (e) oscillate the drawdown pressure about a fourth predetermined target value after (d), wherein the fourth predetermined target value is greater than the third predetermined target value, and the third predetermined target value is greater than the second predetermined target value.

16. The system of claim 15, wherein the controller is further configured to:

oscillate the drawdown pressure during (b) at a first amplitude;

oscillate the drawdown pressure during (c) at a second amplitude;

oscillate the drawdown pressure during (d) at a third amplitude; and oscillate the drawdown pressure during (e) at a fourth amplitude, wherein the first amplitude is greater than the second amplitude, the third amplitude, and the fourth amplitude.

17. A non-transitory machine-readable medium containing instructions that, when executed by a processor, cause the processor to:

actuate a choke valve to adjust a flowrate of formation fluids flowing through an interior of a production tubing located in a subterranean wellbore to oscillate a drawdown pressure of the subterranean wellbore in a predetermined pattern that comprises a plurality of alternating drawdown pressure increases and drawdown pressure decreases, wherein the drawdown pressure increases of the predetermined pattern comprise increases of the drawdown pressure at a first rate, and wherein the drawdown pressure decreases of the predetermined pattern comprise decreases of the drawdown pressure at a second rate that is different from the first rate.

18. The non-transitory machine-readable medium of claim 17, wherein the second rate is greater than the first rate.

19. The non-transitory machine-readable medium of claim 18, wherein the second rate is about 10 to about 20 times the first rate.

20. The non-transitory machine-readable medium of claim 17, wherein the instructions, when executed by the processor, further cause the processor to:

actuate the choke valve to oscillate the drawdown pressure in the predetermined pattern about a first predetermined target value; and then actuate the choke valve to oscillate the drawdown pressure in a second predetermined pattern about a second predetermined target value that is different than the first predetermined target value.

* * * * *